US008356870B2

(12) United States Patent
Nishioka et al.

(10) Patent No.: US 8,356,870 B2
(45) Date of Patent: Jan. 22, 2013

(54) LABEL PRINTER, MEDIA PROCESSING DEVICE, AND MEDIA PROCESSING SYSTEM

(75) Inventors: Atsushi Nishioka, Shiojiri (JP); Junichi Otsuka, Chikuma (JP); Takaaki Taniguchi, Ueda (JP)

(73) Assignee: Seiko Epson Corporation, Tokyo (JP)

( * ) Notice: Subject to any disclaimer, the term of this patent is extended or adjusted under 35 U.S.C. 154(b) by 271 days.

(21) Appl. No.: 12/748,584

(22) Filed: Mar. 29, 2010

(65) Prior Publication Data

US 2010/0253727 A1 Oct. 7, 2010

(30) Foreign Application Priority Data

Apr. 1, 2009 (JP) ..... 2009-088702
Mar. 10, 2010 (JP) ..... 2010-052810

(51) Int. Cl.
*B41J 29/38* (2006.01)
*B41J 2/01* (2006.01)

(52) U.S. Cl. ..... 347/14; 347/104

(58) Field of Classification Search ..... None
See application file for complete search history.

(56) References Cited

U.S. PATENT DOCUMENTS 7,303,344 B2 * 12/2007 Sukigara et al. ..... 400/120.13

FOREIGN PATENT DOCUMENTS

| | | | |
|---|---|---|---|
| JP | 2002-292938 A | | 10/2002 |
| JP | 2004-122583 A | | 4/2004 |
| JP | 2004122583 A | * | 4/2004 |
| JP | 2006-331534 A | | 12/2006 |

* cited by examiner

*Primary Examiner* — Stephen Meier
*Assistant Examiner* — Alexander C Witkowski
(74) *Attorney, Agent, or Firm* — Nutter McClennen & Fish LLP; John J. Penny, Jr.

(57) ABSTRACT

A label printer can reliably print an object in a desired position in the printing area of a recording medium. The label printer has a carriage that moves bi-directionally in a main scanning direction over a disc-shaped recording medium; a printer tray that is disposed movably in a subscanning direction with the recording medium placed thereon; an ink head that is disposed to the carriage and prints a desired object by discharging ink to a printing area on the recording medium in conjunction with movement of the carriage in the main scanning direction and movement of the printer tray in the subscanning direction; a detection unit that is disposed to the carriage and detects a reference position alignment mark that indicates a position used as a reference for appropriately printing the object in the printing area of the recording medium; and a printing position control unit that rotates the recording medium so that the object is printed in the printing area of the recording medium based on the reference position alignment mark detection result from the detection unit.

11 Claims, 12 Drawing Sheets

LABEL PRINTER, MEDIA PROCESSING DEVICE, AND MEDIA PROCESSING SYSTEM

BACKGROUND

1. Technical Field

The present invention relates to a media processing device that writes data to disc-shaped recording media such as CD or DVD media and prints on the label side of the recording media, and relates to a media processing system that includes the media processing device and a host computer that controls operation of the media processing device.

2. Related Art

Media processing devices that have a media storage unit for storing recording media such as CD or DVD media, a label printer for printing an object such as a user-selected image or title describing the content of the recorded data on the label side of the recording media to which data is recorded, a media transportation mechanism for conveying the recording media, and a control unit for controlling the operation of other parts of the media processing device are known from the literature. See, for example, Japanese Unexamined Patent Appl. Pub. JPA-2006-331534.

The label printer included in the media processing device taught in JP-A-2006-331534 can print a desired object (image) on the label side of the recording medium as a result of a print head discharging ink while moving bi-directionally over the label side of the recording medium as the tray on which the recording medium is carried slides.

However, with the label printer according to the related art, when an image or text is to be printed to a specific area on the label surface of a recording medium on which a reference position is determined by marks that are preprinted on the label side, the image or text may be printed outside of the defined printing area if the recording medium is not placed on the tray so that the reference position is in a predetermined location. It is typically necessary in such situations to test print the image or text on the recording medium or printing paper and then adjust for any deviation from the intended printing position.

SUMMARY

A first aspect of the invention is a label printer having a carriage that moves bi-directionally in a main scanning direction over a disc-shaped recording medium; a printer tray that is disposed movably in a subscanning direction with the recording medium placed thereon; an ink head that is disposed to the carriage and prints a desired object by discharging ink to a printing area on the recording medium in conjunction with movement of the carriage in the main scanning direction and movement of the printer tray in the subscanning direction; a detection unit that is disposed to the carriage and detects a reference position alignment mark that indicates a position used as a reference for appropriately printing the object in the printing area of the recording medium; and a printing position control unit that rotates the recording medium so that the object is printed in the printing area of the recording medium based on the reference position alignment mark detection result from the detection unit.

The label printer according to this aspect of the invention can thus detect the angle of rotation indicating how far the position where the recording medium is loaded on the printer tray is rotated from the loading position (reference loading position) at which an image, text, or other print object can be appropriately printed in the printing area of the recording medium, and based on the detected angle of rotation can rotate the recording medium so that the printing area of the print object is set to the reference loading position. As a result, print objects can be reliably printed in the printing area of the recording medium even when the recording medium is loaded at a position rotated from the reference loading position.

In another aspect of the invention, the printing position control unit rotates the object so that the object is printed in the printing area of the recording medium based on the reference position alignment mark detection result from the detection unit.

This aspect of the invention can reliably print an object in the printing area of the recording medium even when the recording medium is placed at a rotated position offset from the reference loading position.

In another aspect of the invention, the detection unit detects some other object printed in the printing area as the reference position alignment mark. This aspect of the invention enables identifying the angle of rotation without forming a reference position alignment mark on the recording medium.

In another aspect of the invention, the reference position alignment mark is printed by the ink head, and the object is printed based on the result of detecting the printed reference position alignment mark. As a result, a reference position alignment mark does not need to be previously rendered on the recording medium.

Another aspect of the invention is a media processing device including the label printer described herein; a media storage unit that stores a plurality of disc-shaped recording media; and a media transportation unit that conveys the recording media to the media storage unit and the label printer.

When the label printer prints an object to a specific printing area on the recording medium, the media processing device according to this aspect of the invention can suitably detect recording media that are placed at a position rotated away from the reference loading position using the angle of rotation as a parameter.

Another aspect of the invention is a media processing system including the media processing device described above, and a host computer that controls operation of the media processing device.

The media processing system according to this aspect of the invention achieves the same effect as the media processing device described above. In addition, a single host computer can control a plurality of media processing devices, and the label printer of each media processing device can suitably detect recording media that are placed rotated away from the reference loading position using the angle of rotation as a parameter in order to print an object in a specific printing area on the recording media.

The foregoing summary of the invention does not include all essential features of the invention, and the invention can also be achieved using various sub-combinations of these feature groups.

Other objects and attainments together with a fuller understanding of the invention will become apparent and appreciated by referring to the following description and claims taken in conjunction with the accompanying drawings.

DESCRIPTION OF EMBODIMENTS

Preferred embodiments of the present invention are described below with reference to the accompanying figures. It will be obvious to one with ordinary skill in the related art that the invention as described in the accompanying claims is not limited to the following embodiments, and embodiments of the invention that do not use all features described in the following embodiments are also conceivable.

Figure 1:
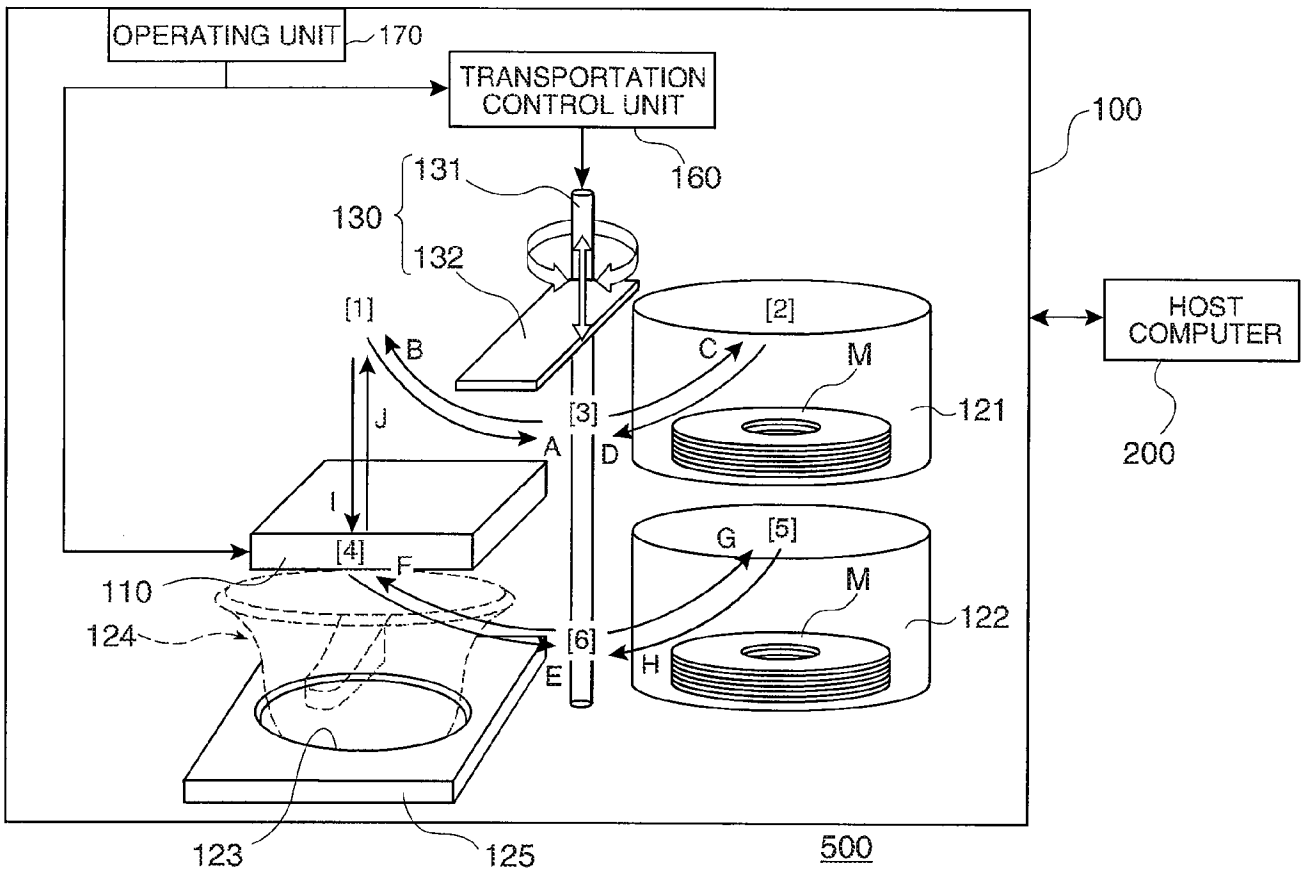
FIG. 1 is a block diagram schematically showing the configuration of a media processing system 500 according to a preferred embodiment of the invention.
Figure 2:
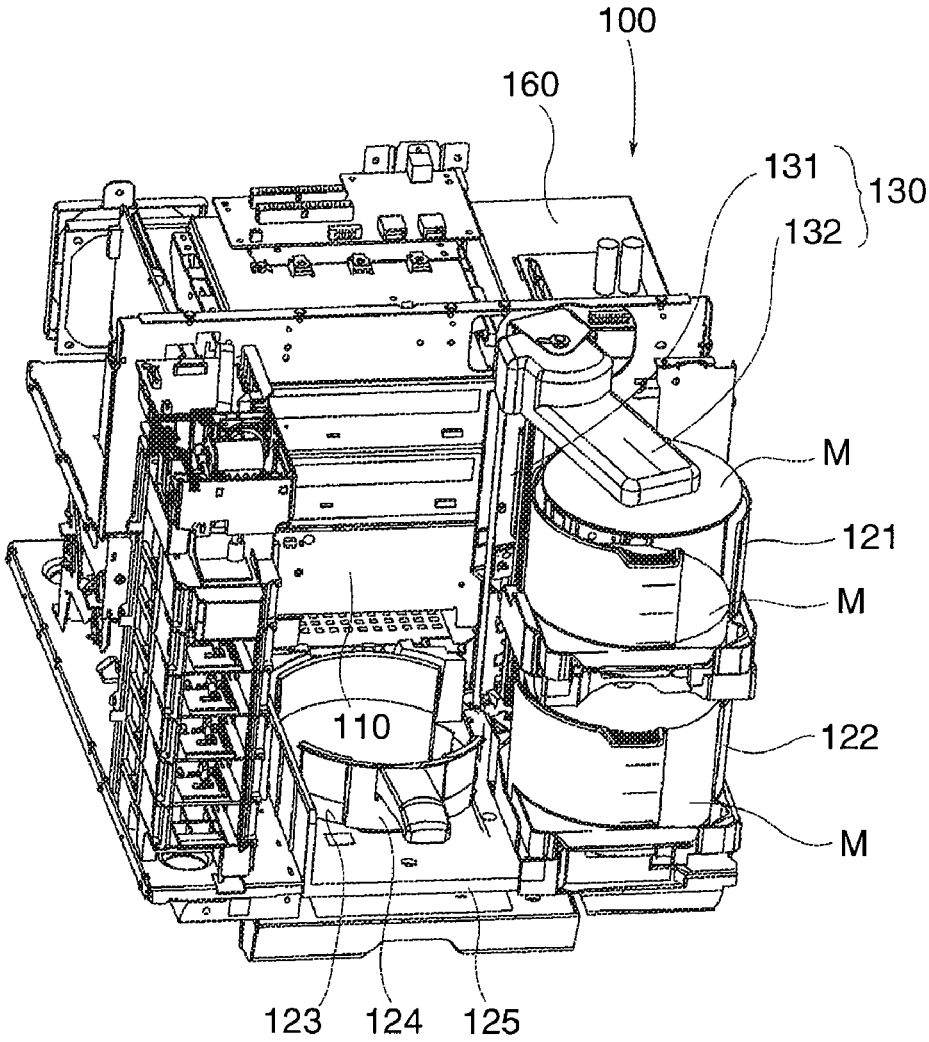
FIG. 2 is an oblique view showing the internal configuration of the media processing device 100.

FIG. 1 is a block diagram schematically describing the configuration of a media processing system 500 according to a preferred embodiment of the invention. FIG. 2 is an oblique view showing the internal configuration of the media processing device 100.

The media processing system 500 includes a media processing device 100 that can read and write data on disc-shaped recording media such as CD or DVD media, and can print on the label surface of the recording medium M, and a host computer 200 that controls operation of the media processing device 100.

As shown in FIG. 1 and FIG. 2, the media processing device 100 has four (first to fourth) media storage units 121, 122, 123, and 124, a label printer 110, a media transportation unit 130, a media identification unit 150, a transportation control unit 160, and an operating unit 170.

Note that the rectangular box-like external case of the media processing device 100 is not shown in FIG. 2 so that the internal device configuration can be seen, but an external case is installed during normal use. An access cover that opens and closes for loading and removing the recording media M is also attached to the front of the case, and an operating unit 170 having indicators, buttons, or other operating devices is disposed to the top of the case.

The first media storage unit 121 and the second media storage unit 122 that is disposed directly below the first media storage unit 121 can be installed to and removed from the frame of the media processing device 100, and each can store a plurality of recording media M. FIG. 1 and FIG. 2 show a plurality of recording media M stored in both the first media storage unit 121 and the second media storage unit 122.

The third media storage unit 123 is a recess formed in a pull-out tray 125 that is slidably disposed to the front of the media processing device 100, and is used to store a small number of recording media M.

The fourth media storage unit 124 can be removably affixed in the third media storage unit 123, and can hold a greater number of recording media M than the third media storage unit 123.

When data is written to and labels are printed on recording media M using the media processing device 100, the first media storage unit 121 is used as a supply stacker that stores the recording media M to be processed. The second media storage unit 122 and the fourth media storage unit 124 are used as discharge stackers that store the recording media M after data recording and label printing operations are completed.

Alternatively, the first media storage unit 121 may be used as a discharge stacker, or the second media storage unit 122 and fourth media storage unit 124 may be used as supply stackers. The third media storage unit 123 is rendered as a discharge stacker that is used when the fourth media storage unit 124 being used as a discharge stacker is removed. As a result, by thus providing a third media storage unit 123, as the processes of writing data and printing labels on the recording media M continue and the fourth media storage unit 124 becomes full so that it cannot store any more recording media M, the fourth media storage unit 124 can be removed and the recording media M stored thereinside can be recovered (removed) while the data writing and label printing processes continue.

The label printer 110 has an inkjet recording device that can print on the label side of the recording media M. The label printer 110 can print a user-specified image (label image) on the label side of the recording medium M carried on the printer tray 30 described below. The configuration of the label printer 110 is described in detail further below.

The media transportation unit 130 has a vertical guide shaft 131 disposed substantially vertically, and a transportation arm 132 that can move vertically and pivot horizontally on the vertical guide shaft 131. Claws, for example, for holding the recording medium M are disposed in the middle of the distal end part of the transportation arm 132.

The transportation arm 132 can pivot horizontally in the directions of arrows A to H in FIG. 1, and can move up and down in the direction of arrows I and J. By combining these operations the transportation arm 132 can move to any of the transportation destinations (positions) labelled [1] to [6] in FIG. 1. As a result, the transportation arm 132 can transport the recording media M between the media storage units 121, 122, 123, 124 (more particularly, either the third media storage unit 123 or the fourth media storage unit 124) and the media transfer position of the label printer 110.

The transportation destinations (positions) labelled [1] to [6] in FIG. 1 are described more specifically next. That is, position [1] is the home position (HP) (standby position) of the transportation arm 132; position [2] is the location of the first media storage unit 121; position [3] is any desired position between the home position and the location of the first media storage unit 121; position [4] is the media transfer position of the label printer 110; position [5] is the location of the second media storage unit 122; and position [6] is any desired position between the media transfer position of the label printer 110 and the location of the second media storage unit 122.

The transportation control unit 160 controls driving the media transportation unit 130. Based on information (drive control information) related to drive control of the media transportation unit 130 input by the user from the operating unit 170, or based on such drive control information input from a host computer 200, the transportation control unit 160 controls operation of the media transportation unit 130. For example, based on this drive control information, the transportation control unit 160 outputs commands to the media transportation unit 130 for conveying recording media M from the first media storage unit 121 to one of the other media storage units 122, 124 or the media transfer position of the label printer 110.

The operating unit 170 receives and passes control information input by the user related to the operation of the media processing device 100 to the label printer 110 and transportation control unit 160. Note that if operation of the label printer 110 and media transportation unit 130 is controlled based on control information from the host computer 200, the media processing device 100 does not need to be provided with an operating unit 170.

Figure 3:
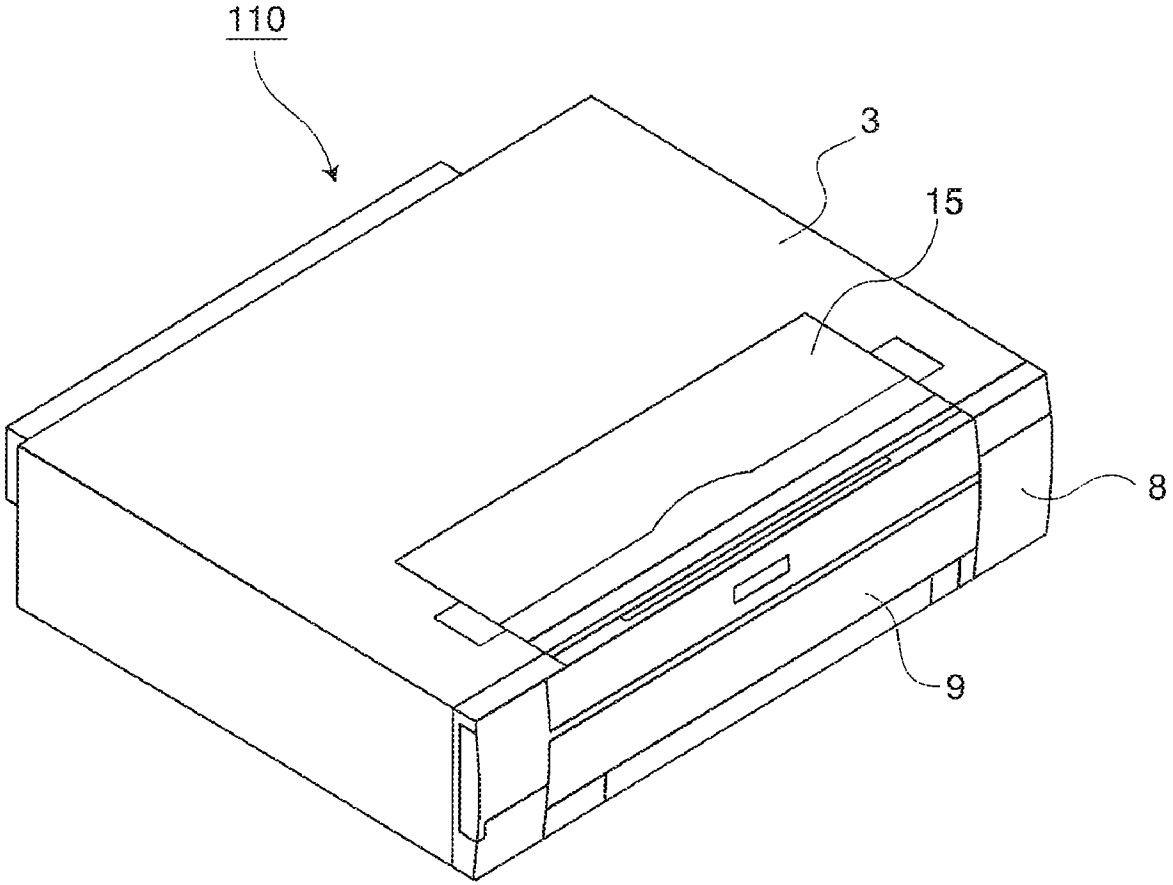
FIG. 3 is an oblique view showing the outside of a label printer 110.
Figure 4:
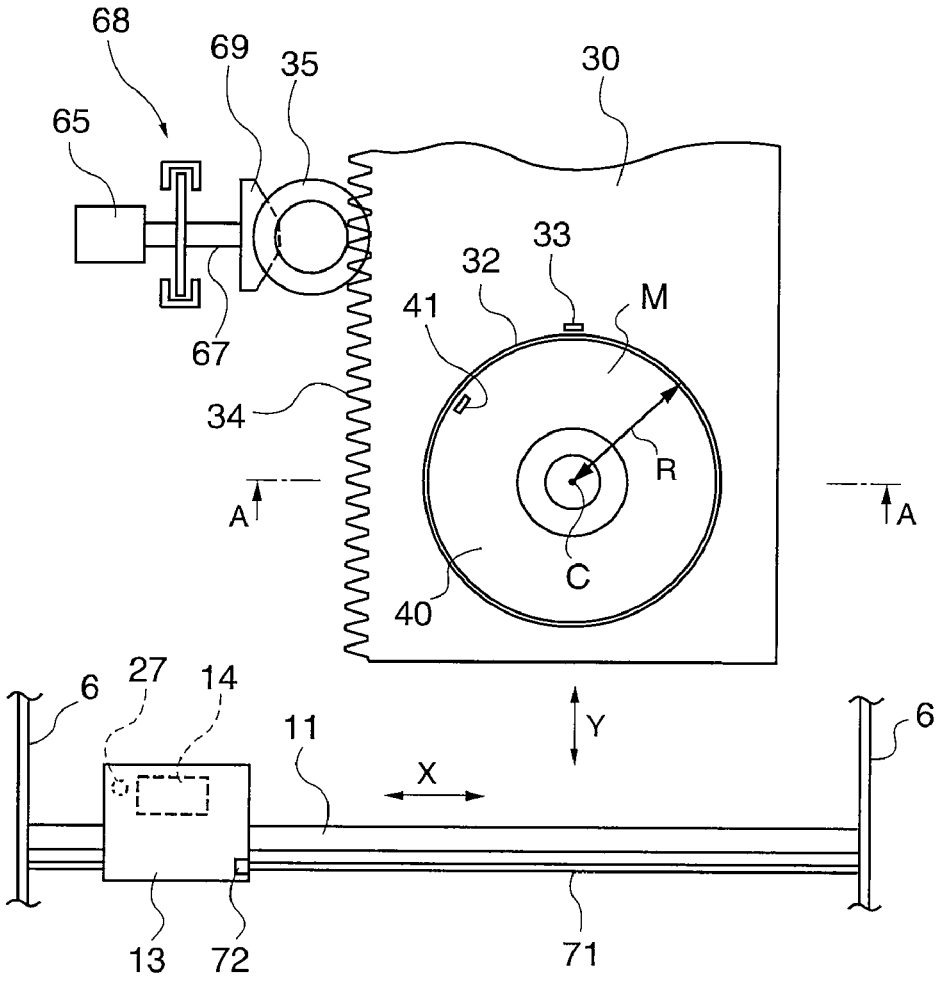
FIG. 4 is a plan view schematically describing the internal configuration of the label printer 110.
Figure 5:
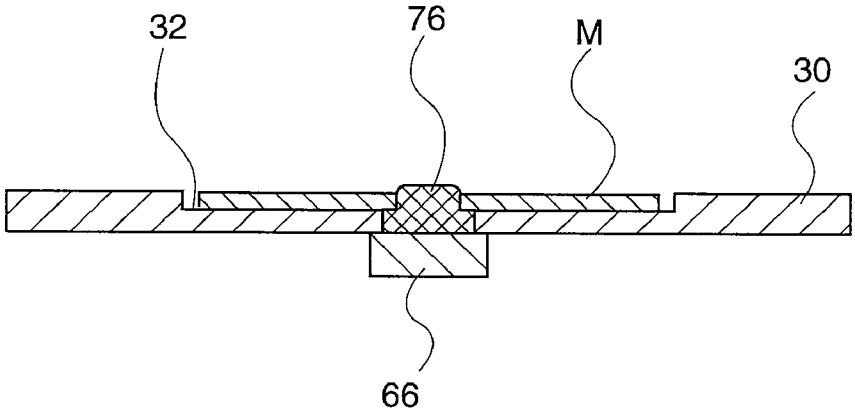
FIG. 5 is a schematic section view through line A-A in FIG. 4 looking in the direction of the arrows.
Figure 6:
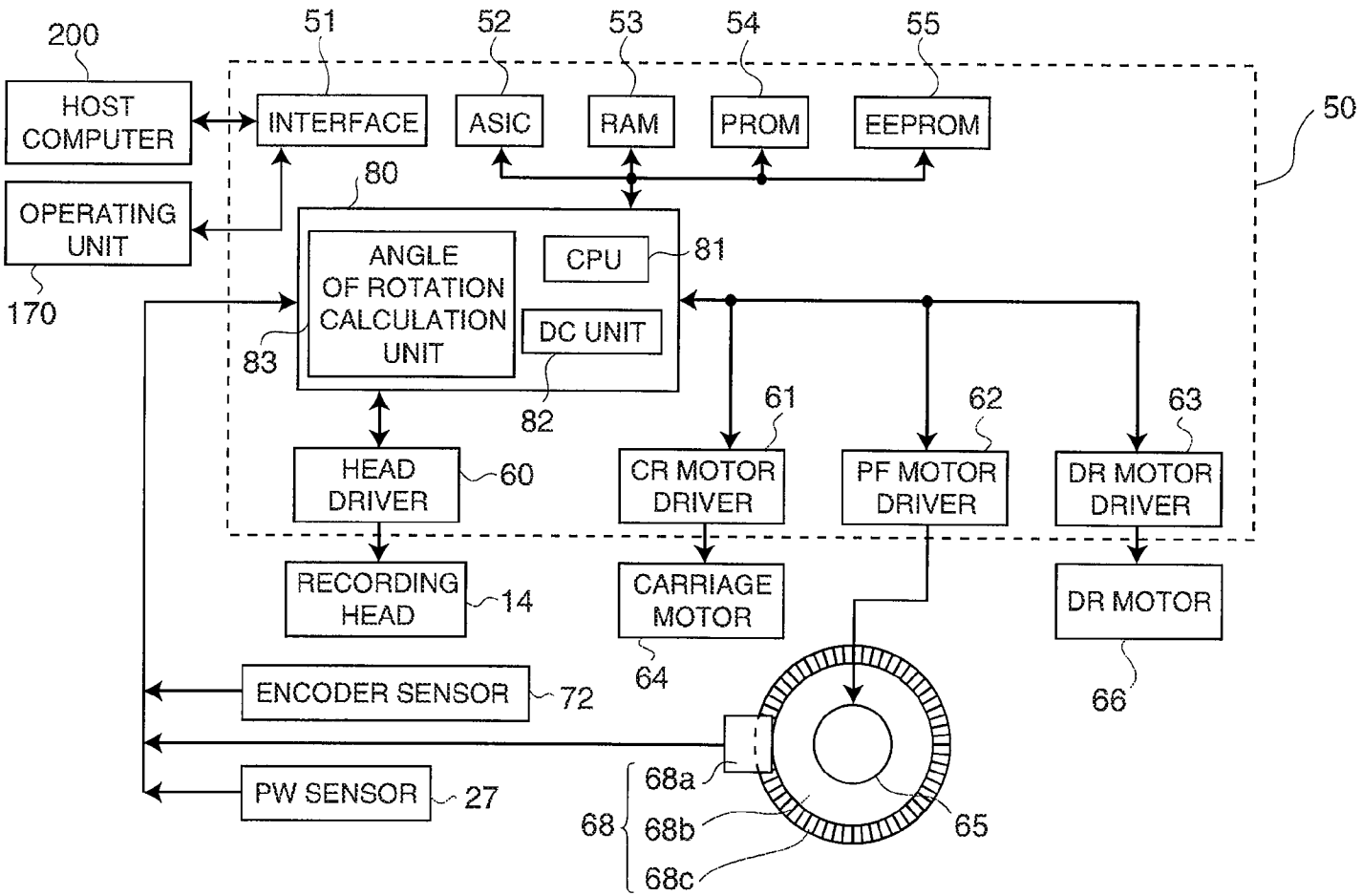
FIG. 6 is a block diagram of the printer control unit 50 that controls the label printer 110.

FIG. 3 is an oblique view showing the appearance of the label printer 110. FIG. 4 is a plan view schematically describing the internal configuration of the label printer 110. FIG. 5 is a schematic section view through line A-A in FIG. 4 looking in the direction of the arrows. FIG. 6 is a block diagram of the printer control unit 50 that controls the label printer 110.

As shown in FIG. 3, the label printer 110 has a housing 3 that covers the sides, top, and back of the label printer 110, a front cover 8 disposed to the front of the label printer 110, and an access cover 9 disposed to the front of the front cover 8 so that the access cover 9 can open and close. An ink cartridge unit 15 that holds a plurality of ink cartridges inside is removably disposed above the front cover 8.

As shown in FIG. 4, a side frame member 6 that is parallel to the depth direction (the sub-scanning direction, that is, the direction indicated by the arrow Y in FIG. 4) of the label printer 110 is disposed on both sides inside the label printer 110, and the main carriage guide shaft 11, carriage 13, and linear encoder 71 are disposed between the side frame members 6.

The main carriage guide shaft 11 is a rod-shaped member extending widthwise to the label printer 110 (the main scanning direction, the direction indicated by arrow X in FIG. 4), and the ends of the main carriage guide shaft 11 are affixed to the side frame members 6.

The main carriage guide shaft 11 passes through the back of the carriage 13, and the carriage 13 can be moved bidirectionally in the main scanning direction by drive power from the carriage motor 64. Controlling driving the carriage 13 by means of the carriage motor 64 is described further below, but the carriage 13 drive mechanism including the carriage motor 64 is not shown in the figures.

A recording head 14 in which a plurality of ink discharge openings (ink nozzles) are formed is disposed below the carriage 13. During the operation of printing to the label side 40 of the recording medium M loaded on the printer tray 30, the recording head 14 discharges ink supplied from a plurality of ink cartridges inside the ink cartridge unit 15 to the label side 40.

A PW sensor 27, which is an example of a detection unit according to the present invention, is disposed to the bottom of the carriage 13. The PW sensor 27 may be an optical sensor including, for example, a light-emitting unit that emits light to the printer tray 30 side, and a photodetection unit that receives and detects light reflected from the printer tray 30. The PW sensor 27 is used to detect if a recording medium M is present on the printer tray 30. The PW sensor 27 is also used to detect a reference position alignment mark 41 that denotes the reference position of the label side 40 of the recording medium M on the printer tray 30.

The linear encoder 71 is a substantially flat member disposed parallel to the main carriage guide shaft 11 with part thereof below an encoder sensor 72 disposed to the carriage 13. The linear encoder 71 has a plurality of light-passing units (not shown in the figure) rendered at a uniform interval in the main scanning direction. The encoder sensor 72 emits light to the linear encoder 71 and detects the light passing through the light-passing units of the linear encoder 71 to output a signal denoting the absolute position of the carriage 13 in the main scanning direction.

As shown in FIG. 4 and FIG. 5, a media loading unit 32 is formed in the top of the printer tray 30. In this embodiment of the invention the media loading unit 32 is a recess of substantially the same size as the recording medium M formed in the top of the printer tray 30. A media spindle 76 is disposed in the center of the media loading unit 32.

The media spindle 76 is a round rotating shaft that projects upward from the center of the media loading unit 32, and is rotated by drive power from a DR motor 66 that is disposed on the back side of the printer tray 30. The recording medium M is held on the media spindle 76 by passing the media spindle 76 through a round hole formed in the center of the recording medium M. The recording medium M affixed to the media spindle 76 then rotates in conjunction with the rotation of the media spindle 76 driven by drive power from the DR motor 66. Note that the media spindle 76 and DR motor 66 are an example of a rotating mechanism for causing the recording medium M to rotate.

As shown in FIG. 4, a rack 34 is rendered on one side of the printer tray 30 in the subscanning direction. The rack 34 meshes with a pinion 35 that is rotated by drive power from a PF motor 65 described below. The printer tray 30 moves in the subscanning direction while carrying a recording medium M placed thereon as a result of the pinion 35 being turned by drive power from the PF motor 65. In this embodiment of the invention the printer tray 30 can slide between a holding position to which the printer tray 30 is retracted inside the label printer 110, and a media transfer position where the recording medium M can be deposited on and picked up from the media transportation unit 130.

A rotary encoder 68 includes a disk-shaped scale **68*b* attached to a drive shaft 67 that is driven rotationally by the PF motor 65, a plurality of transparent parts 68*c* disposed around the perimeter of the scale 68*b*, and a detection unit 68*a* including a light-emitting unit that emits light to the transparent parts 68*c* and a photodetection unit that receives light passing through the transparent parts 68*c*. The detection unit 68*a* of the rotary encoder 68 outputs leading edge signals and trailing edge signals produced by the light passing through the transparent parts 68*c* when the scale 68*b* rotates to the printer control unit 50**.

The printer control unit 50 receives data that is sent from the host computer 200 or input by the user from the operating unit 170 and is related to the printing operation of the label printer 110, and outputs information related to print settings or the print result of the label printer 110 to the host computer 200 or the operating unit 170. In this embodiment of the invention the printer control unit 50 is disposed inside the label printer 110, but may be separately disposed externally to the label printer 110.

As shown in FIG. 6, the printer control unit 50 includes an interface (IF) 51, ASIC 52, RAM 53, PROM 54, EEPROM 55, a head driver 60, a CR motor driver 61, a PF motor driver 62, a DR motor driver 63 [62, sic], and a printing operation control unit 80.

The interface 51 enables data communication with the host computer 200 or operating unit 170. The ASIC 52 outputs control signals for controlling operation of the recording head 14 based on information related to the printing resolution or recording head 14 drive wave, for example, that is contained in data received from the host computer 200 through the interface 51.

RAM 53 is used as working memory for the ASIC 52 and the printing operation control unit 80, and as the primary data storage area.

A control program (firmware) and data that are required to control the label printer 110 are stored in PROM 54 and EEPROM 55.

The printing operation control unit 80 includes a CPU 81, DC unit 82, and angle of rotation calculation unit 83. The CPU 81 performs the operations required to execute the label printer 110 control program. Based on print data sent from the host computer 200, the CPU 81 also generates control signals for controlling driving the recording head 14. The CPU 81 also outputs the generated control signals to the head driver 60.

Based on detection signals from the detection unit 68*a* of the rotary encoder 68, the encoder sensor 72, and the PW sensor 27, the DC unit 82 sends control signals for controlling driving the carriage motor 64, the PF motor 65, and the DR motor 66 to the CR motor driver 61, the PF motor driver 62, and the DR motor driver 63 [62, sic], respectively. The DC unit 82 may include a circuit for handling PID control and PWM control, for example.

During the reference position detection operation described below, the angle of rotation calculation unit 83 calculates the position of the reference position alignment mark 41 detected by the PW sensor 27 based on the detection signals from the detection unit 68*a* of the rotary encoder 68 and the encoder sensor 72. The angle of rotation calculation unit 83 also calculates the angle of rotation that the recording medium M must be turned in order to print the object that is to be printed (the print object, such as text or an image) in the specified printing area 42, 43 on the label side 40 of the recording medium M. Based on the calculated detection position of the reference position alignment mark 41, the angle of rotation calculation unit 83 in this embodiment of the invention calculates how much the recording medium M is rotated from the reference loading position at which the print object can be appropriately printed in the printing area 42, 43 as the angle of rotation, and outputs this angle of rotation information to the DR motor driver 63.

Based on the control signals from the CPU 81, the head driver 60 then controls driving the recording head 14.

Based on control signals from the DC unit 82, the CR motor driver 61 controls driving the carriage motor 64. The carriage motor 64 produces drive power as controlled by the CR motor driver 61, and thereby causes the carriage 13 to move bi-directionally in the main scanning direction.

The PF motor driver 62 controls driving the PF motor 65 based on control signals from the DC unit 82. The PF motor 65 produces drive power as controlled by the PF motor driver 62, and moves the printer tray 30 in the subscanning direction by rotationally driving the pinion 35 that meshes with the rack 34 formed on the side of the printer tray 30.

The DR motor driver 63 controls driving the DR motor 66 based on information input from the angle of rotation calculation unit 83. In this embodiment of the invention the DR motor driver 63 sends a command to the DR motor 66 to only rotate the recording medium M the angle of rotation input from the angle of rotation calculation unit 83. The DR motor 66 thus causes the recording medium M to turn only this angle of rotation based on the commands from the DR motor driver 63.

Figure 7A:
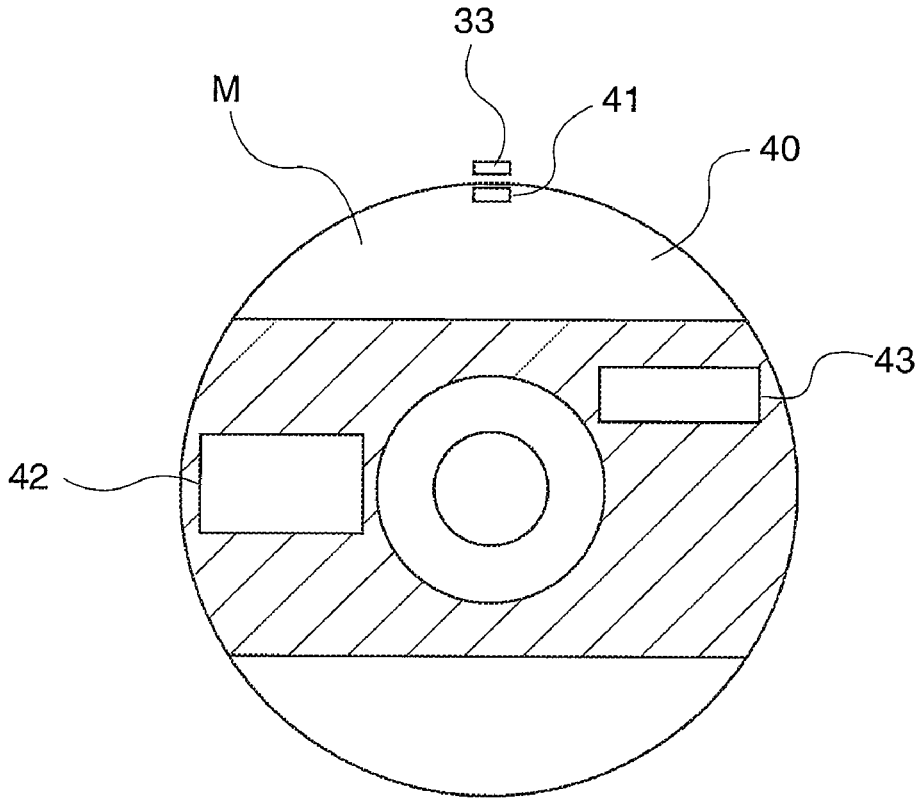
FIG. 7 describes the reference loading position of the recording medium M.

The reference loading position of the recording medium M is described next with reference to FIG. 7 and FIG. 8. FIG. 7 shows the reference loading position of the recording medium M. FIG. 8 shows the recording medium M when placed at a position rotated angle ⟨ from the reference loading position.

A basically rectangular indexing mark 33 that is long in the subscanning direction of the media loading unit 32 is disposed on the top of the printer tray 30. The indexing mark 33 is, for example, colored so that its reflectivity differs from the reflectivity of other parts of the top of the printer tray 30. If the top of the printer tray 30 is black or other color with low reflectivity, the indexing mark 33 is preferably white or other color with high reflectivity.

A reference position alignment mark 41 denoting the reference position of the label side 40 is also disposed near the perimeter of the recording media M printed on by the label printer 110. As shown in FIG. 7A, the recording medium M is placed in the reference loading position when the recording medium M is placed on the media loading unit 32 with the reference position alignment mark 41 aligned with the indexing mark 33.

Note that in this embodiment of the invention the outline of the reference position alignment mark 41 is a rectangle having four sides including straight side 41L and straight side 41L2. The outline of the indexing mark 33 is also a rectangle having four sides including straight side 33L and straight side 33L2. Note that the straight side 41L and straight side 41L2 of the reference position alignment mark 41, and the straight side 33L and straight side 33L2 of the indexing mark 33, are two adjacent perpendicular sides of the respective marks.

Figure 7B:
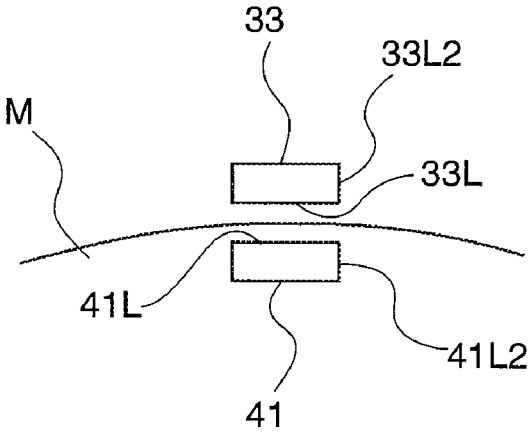
Figure 8:
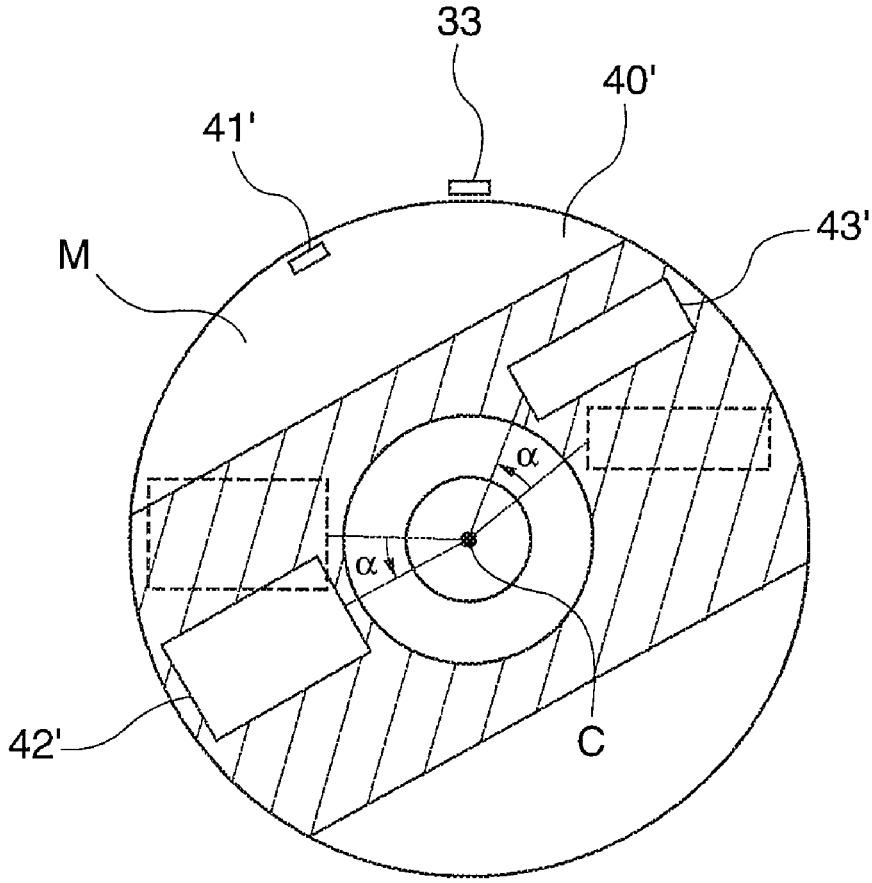
FIG. 8 shows the recording medium M is loaded at a position rotated angle ⟨ from the reference loading position.

When the recording medium M is set to the reference loading position, straight side 41L of the reference position alignment mark 41 is parallel to straight side 33L of the indexing mark 33, and straight side 41L2 of the reference position alignment mark 41 is on an extension of straight side 33L2 of the indexing mark 33, as shown in FIG. 7B. In this position the straight side 41L and straight side 33L are also parallel to the main scanning direction.

If the recording medium M is set to this reference loading position, the label printer 110 can accurately print the print object in the desired printing position (target printing position), such as printing areas 42, 43, which is defined relative to the reference position alignment mark 41 on the label side 40 of the recording medium M. However, when the media processing device 100 is typically used to print specific objects on the label sides 40 of plural recording media M, the recording media M are often set to different positions than the reference loading position.

For example, as shown in FIG. 8, the recording medium M may be placed at a position rotated a certain angle (angle ⟨ in FIG. 8) from the reference loading position. By executing a reference position detection operation to detect the reference position alignment mark 41' of the recording medium M, the label printer 110 of the media processing device 100 can detect that the recording medium M is placed at a position rotated away from the reference loading position, and can thereby print the desired objects in the printing areas 42' and 43'.

Figure 9:
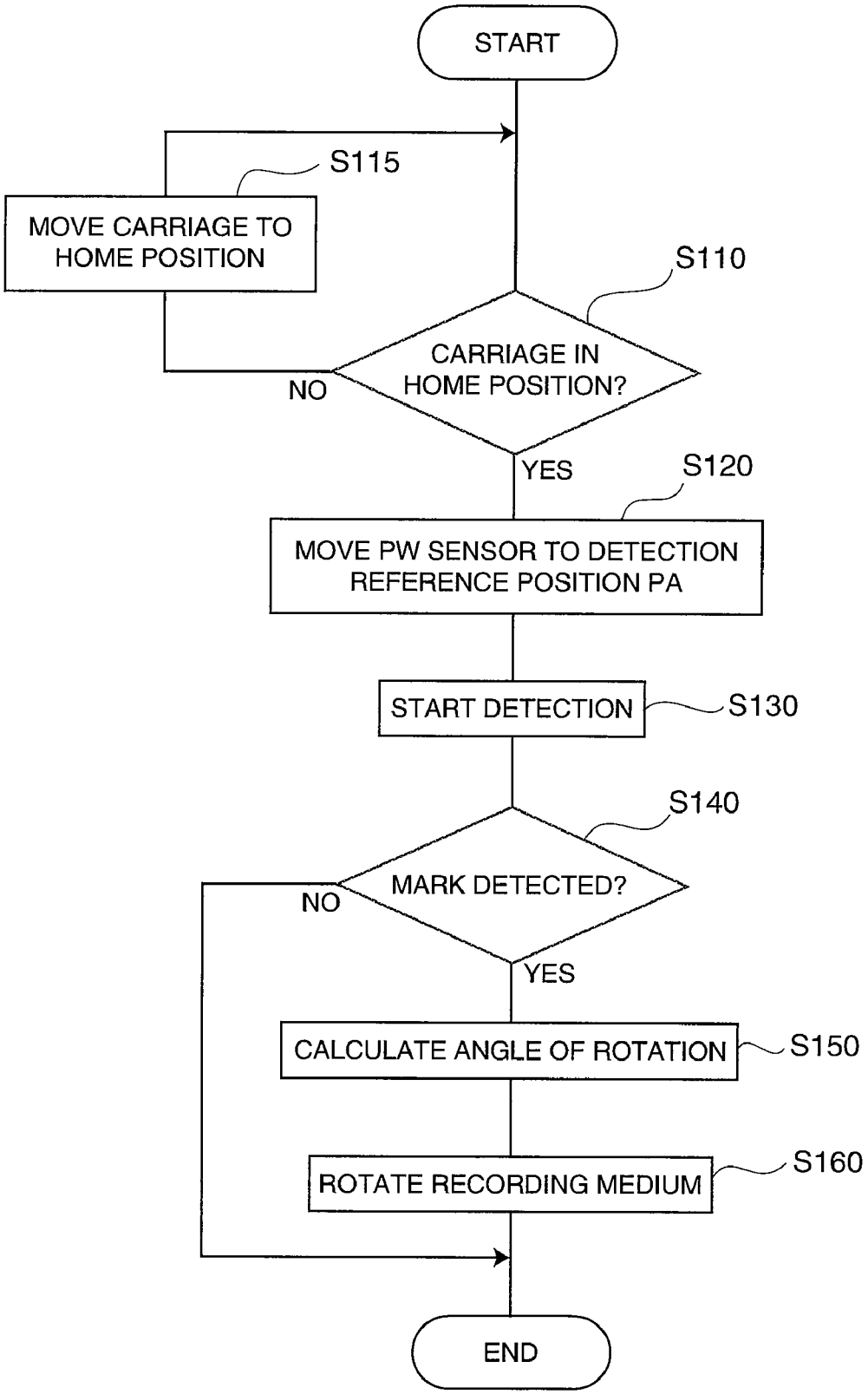
FIG. 9 is a flow chart describing the reference position detection operation of the label printer 110.
Figure 10A:
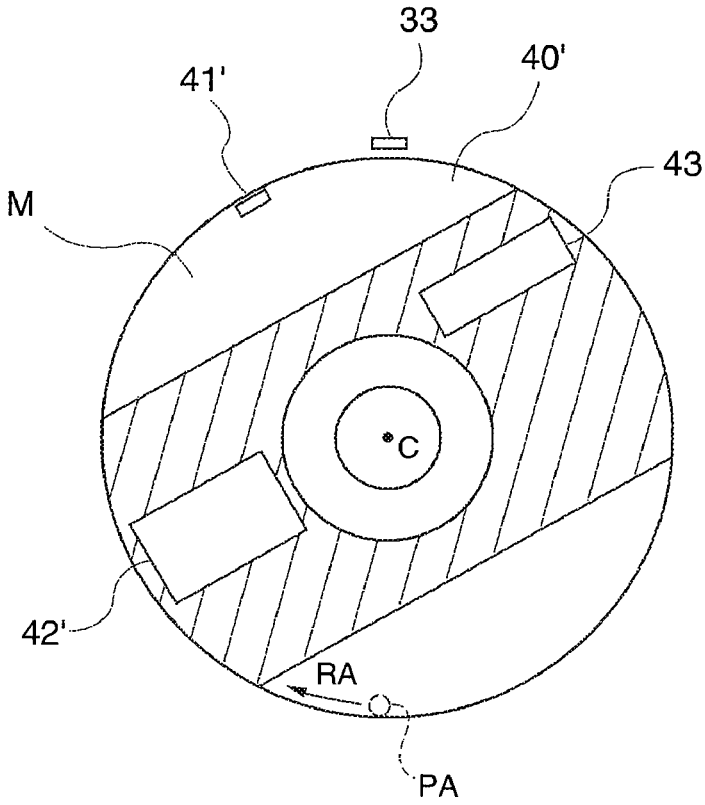
FIG. 10 schematically describes the reference position detection operation when the recording medium M is loaded at a position rotated angle ⟨ from the reference loading position.

The reference position detection operation of the label printer 110 according to this embodiment of the invention is described next with reference to FIG. 9 and FIG. 10. FIG. 9 is a flow chart of an example of the reference position detection operation of the label printer 110. FIG. 10 schematically describes the reference position detection operation when the recording medium M is placed at a position rotated angle ⁘ from the reference loading position.

When executing the reference position detection operation, the label printer 110 first determines if the carriage 13 is in the home position (such as the position shown in FIG. 4) (step S110). If the carriage 13 is in the home position (step S110 returns Yes), the label printer 110 moves the carriage 13 so that the PW sensor 27 is at the detection reference position (the position denoted PA in FIG. 10A) (step S120). Note that this detection reference position PA may be any predefined position near the outside perimeter of the label side 40' of the recording medium M, such as a position opposite the indexing mark 33 with the axis of rotation (denoted C in FIG. 10A) of the recording medium M therebetween.

If the carriage 13 is not in the home position in step S110 (step S110 returns No), the label printer 110 moves the carriage 13 to the home position, and then again detects if the carriage 13 is in the home position (step S110).

The label printer 110 starts the operation detecting the reference position alignment mark 41' once the PW sensor 27 is in the detection reference position (step S130). In this embodiment of the invention the label printer 110 moves the carriage 13 so that the PW sensor 27 moves along the outside circumference (in the direction indicated by arrow RA in FIG. 10A) of the recording medium M.

If the reference position alignment mark 41' is detected by the PW sensor 27 (step S140 returns Yes), the angle of rotation calculation unit 83 of the label printer 110 calculates the angle of rotation of the recording medium M based on the detected position of the reference position alignment mark 41' (step S150). If the reference position alignment mark 41' is not detected by the PW sensor 27 (step S140 returns No), the reference position detection operation ends.

Figure 10B:
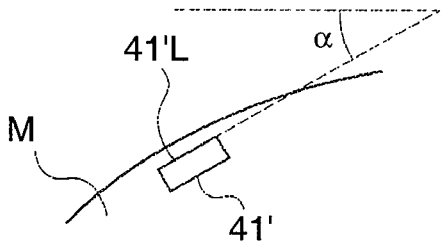

The operation of step S150 is described in more detail next. As shown in FIG. 10B, the straight side 41'L of the reference position alignment mark 41' is sloped to the main scanning direction by the same angle (⁘) as the angle of rotation of the recording medium M. The angle of rotation calculation unit 83 calculates the angle of rotation of the recording medium M from the size of this slope detected by the PW sensor 27. Note, further, that in step S150 the slope (angle) of the straight side 41'L to the subscanning direction may be detected by the PW sensor 27, and the angle of rotation calculation unit 83 may calculate the angle of rotation of the recording medium M from the size of this slope.

If the angle of rotation calculation unit 83 calculates that the angle of rotation from the reference loading position of the recording medium M is ⁘, information about the angle of rotation is output to the DR motor driver 63. The DR motor driver 63 then sends a command causing the recording medium M to be rotated only angle ⁘ to the DR motor 66 (step S160).

This ends the reference position detection operation.

As described above, a label printer 110 having the printer control unit 50 according to this embodiment of the invention rotates the printing areas 42' and 43' of the recording medium M, that is, the target positions for printing, to the intended printing position of the print object, and can thereby reliably print the objects in the desired printing areas 42' and 43' of the recording medium M.

Figure 11:
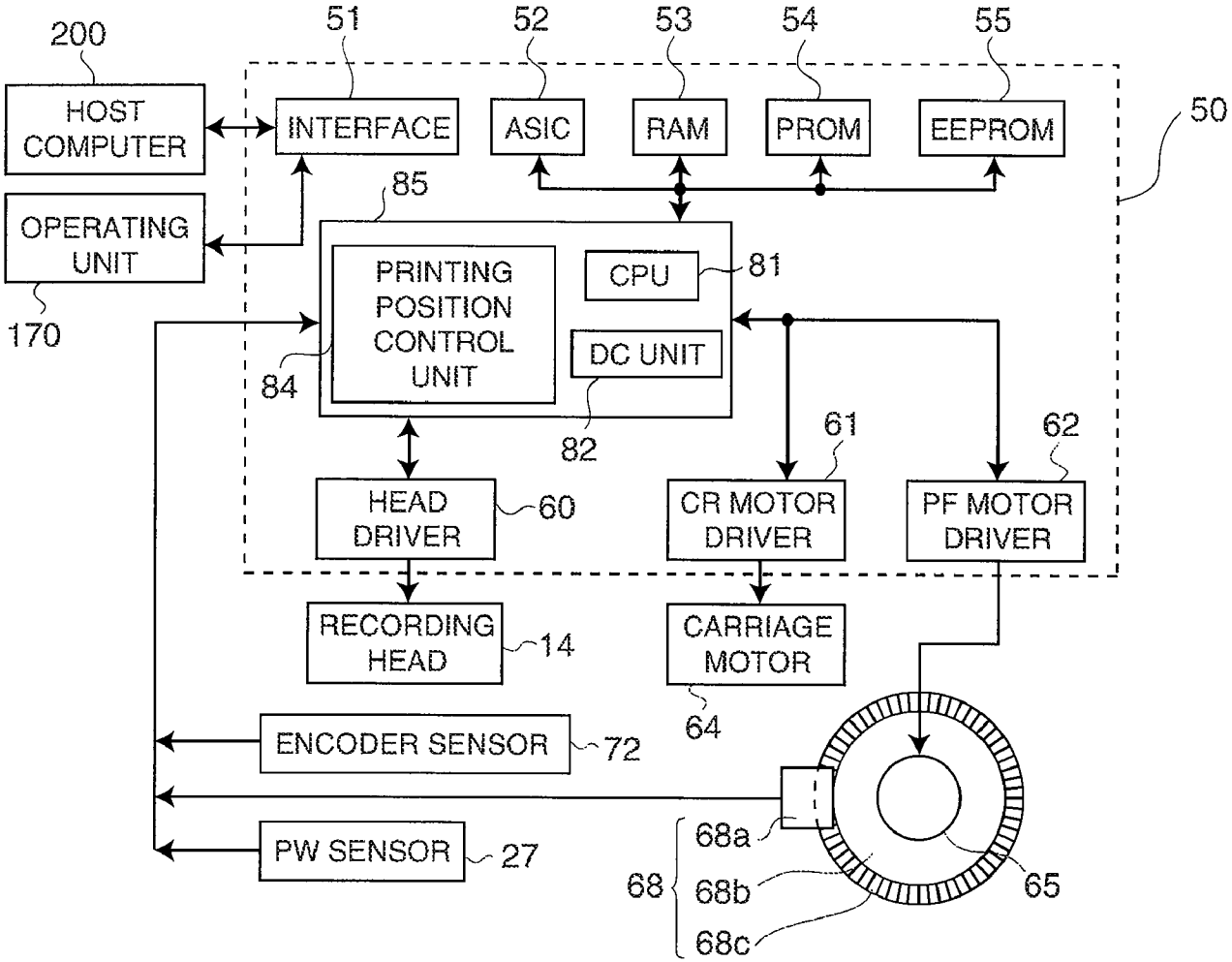
FIG. 11 is a block diagram showing the configuration of the printer control unit 50 that controls operation of the label printer 110 according to another embodiment of the invention.

FIG. 11 is a block diagram describing another configuration of a printer control unit 50 that controls the label printer 110. The printer control unit 50 may be configured as shown in FIG. 11 instead of using the configuration shown in FIG. 6. More specifically, the printing operation control unit 85 shown in FIG. 11 replaces the printing operation control unit 80 shown in FIG. 6, and the DR motor driver 63 and DR motor 66 shown in FIG. 6 may be omitted. The printing operation control unit 85 of the printer control unit 50 in this embodiment of the invention has a printing position control unit 84 instead of the angle of rotation calculation unit 83 described above.

Similarly to the angle of rotation calculation unit 83, the printing position control unit 84 calculates the angle of rotation of the recording medium M from the reference loading position during the reference position detection operation. The printing position control unit 84 then rotates the print data relative to the center of the recording medium M so that the printing position of the print object moves to the target printing position of the recording medium M.

Figure 12:
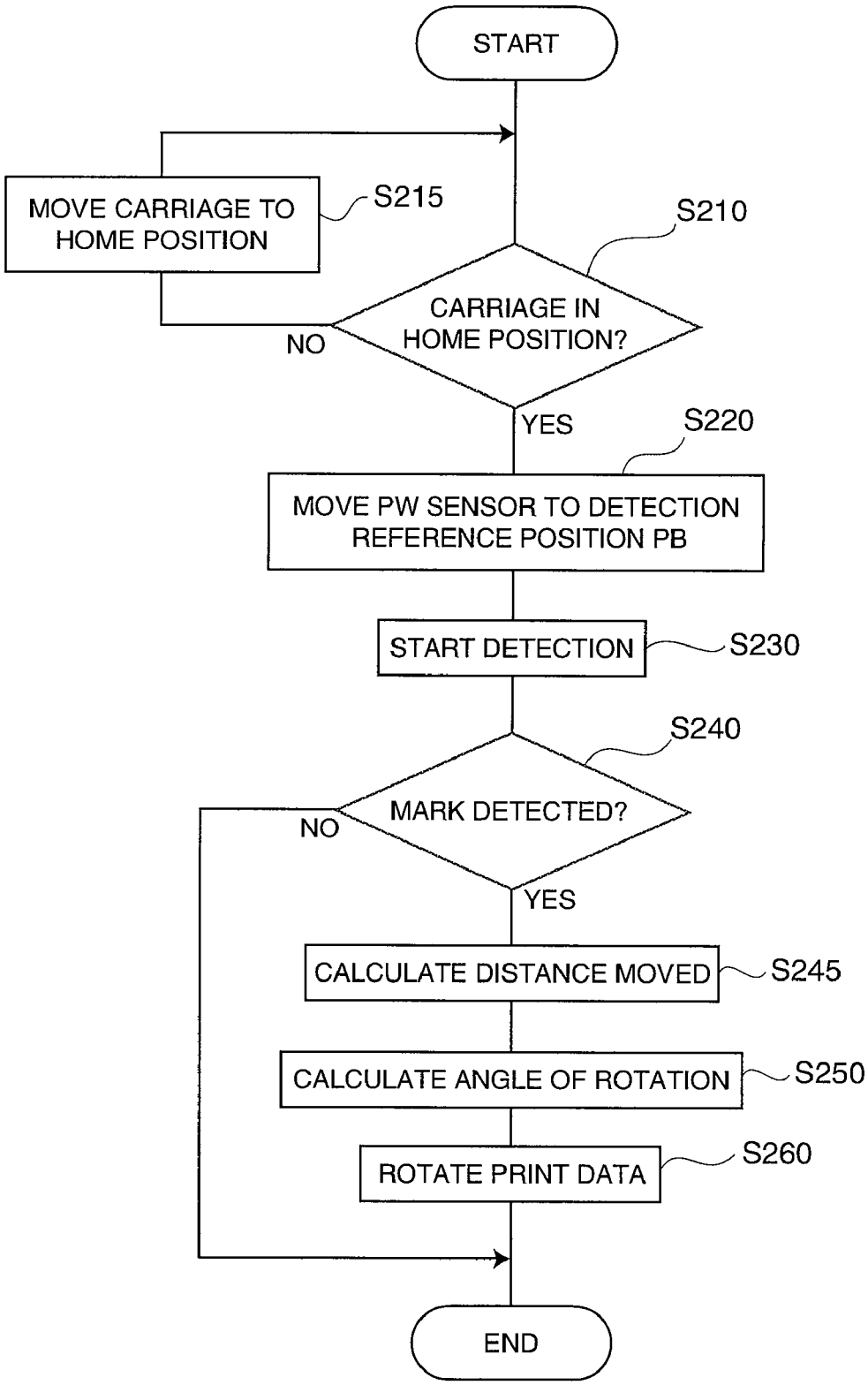
FIG. 12 is a flow chart describing another example of the reference position detection operation of the label printer 110.
Figure 13A:
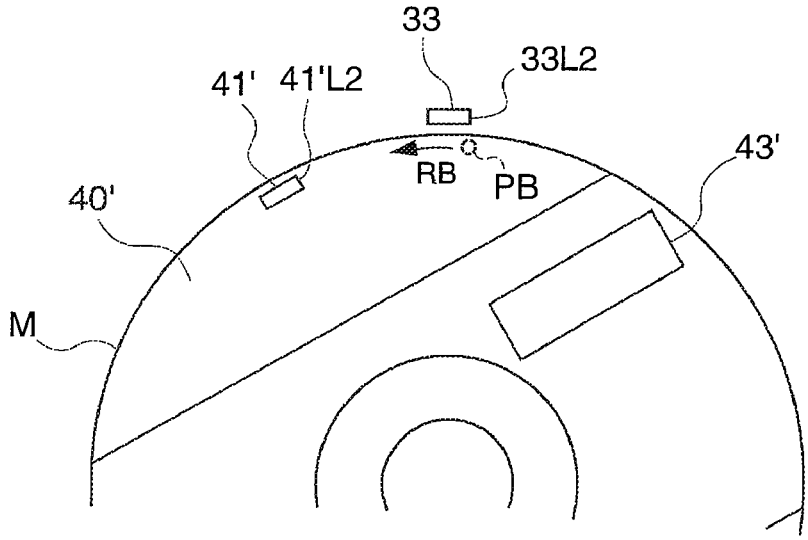
FIG. 13 schematically describes the reference position detection operation when the recording medium M is loaded at a position rotated angle ß from the reference loading position.
Figure 13B:
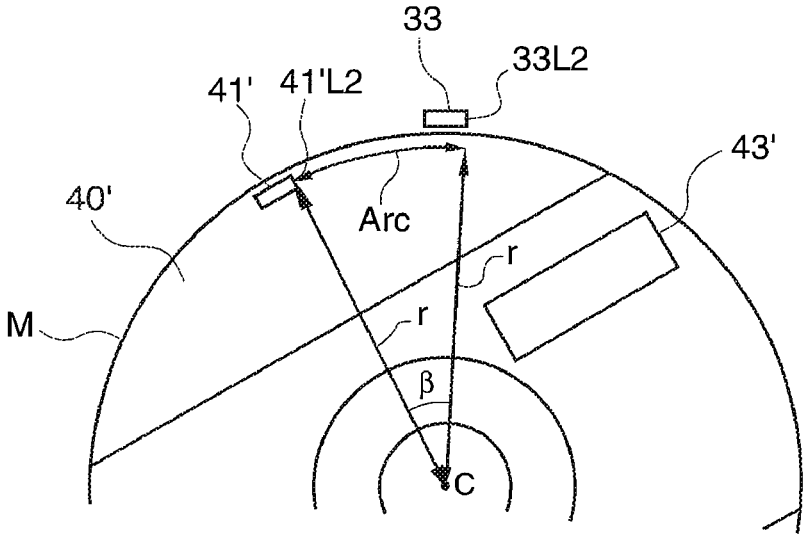

An example of the reference position detection operation executed by the label printer 110 having the printer control unit 50 configured as shown in FIG. 11 is described next with reference to FIG. 12 and FIG. 13. FIG. 12 is a flow chart showing another example of the reference position detection operation of the label printer 110. FIG. 13 schematically describes the reference position detection operation when the recording medium M is loaded to a position rotated angle ⁘ from the reference loading position.

In the reference position detection operation according to this embodiment of the invention, the label printer 110 first detects if the carriage 13 is in the home position (step S210). If the carriage 13 is in the home position (step S210 returns Yes), the label printer 110 moves the carriage 13 so that the PW sensor 27 is at the detection reference position (the position denoted PB in FIG. 13A) (step S220). Note that in this embodiment the detection reference position PB is a position on an extension of straight side 33L2 of the indexing mark 33.

If the carriage 13 is not in the home position in step S210 (step S210 returns No), the label printer 110 moves the carriage 13 to the home position, and then again detects if the carriage 13 is in the home position (step S210).

The label printer 110 starts the operation detecting the reference position alignment mark 41' once the PW sensor 27 is in the detection reference position PB (step S230). In this embodiment of the invention the label printer 110 moves the carriage 13 so that the PW sensor 27 moves along the outside circumference (in the direction indicated by arrow RB in FIG. 13A) of the recording medium M.

If the straight side 41'L2 of the reference position alignment mark 41' is detected by the PW sensor 27 (step S240 returns Yes), the printing position control unit 84 calculates the distance moved by the PW sensor 27 from the detection reference position PB based on the detected position of the straight side 41'L2 (step S245). Based on the calculated distance moved, the printing position control unit 84 calculates the angle of rotation of the recording medium M (step S250). More specifically, the printing position control unit 84 calculates the angle of rotation of the recording medium M based on the distance moved from the detection reference position PB by the PW sensor 27, and the distance between the PW sensor 27 and the axis of rotation of the recording medium M (the position denoted C in FIG. 13B), that is, the length of radius r in FIG. 13B.

If the reference position alignment mark 41' is not detected by the PW sensor 27 (step S240 returns No), the reference position detection operation ends.

If the printing position control unit 84 calculates that the angle of rotation from the reference loading position of the recording medium M is ⇑, the printing position control unit 84 rotates the print data angle ß so that the printing position of the print object is aligned with the target printing position (printing area 42', 43') on the recording medium M (step S260)

This ends the reference position detection operation.

As described above, as a result of executing this reference position detection operation to detect the reference position alignment mark 41' on the recording medium M, the label printer 110 of the media processing device 100 according to this embodiment of the invention can determine the angle of rotation of the recording medium M from the reference loading position and rotate the print data so that the printing position of the print object goes to the target printing position (printing area 42', 43') and can thereby reliably print a desired object in the target printing position of the recording medium M.

It should be noted that a configuration in which the label printer 110 causes the PW sensor 27 to detect a different object printed on the label side 40' (such as a background image preprinted on the label side) as the reference position alignment mark is also conceivable. With this configuration the angle of rotation can be determined without rendering a reference position alignment mark 41 (41') on the recording medium.

Further alternatively, the reference position alignment mark may be printed by the label printer 110.

In this configuration, the label printer 110 detects by means of the PW sensor 27 whether or not the reference position alignment mark is on the label side 40' of the recording medium M located in the printer tray 30. If the reference position alignment mark is not detected, the label printer 110 prints a reference position alignment mark 41 (41') on the label side 40' of the recording medium M. For example, if nothing is printed on the label side of the recording medium, a reference position alignment mark 41 (41') is printed at a position opposite the indexing mark 33. If another object, such as a background picture, is already printed on the label side, and the PW sensor 27 cannot detect this other object as a reference position alignment mark, a reference position alignment mark 41 (41') is printed in the same way as on a recording medium that has nothing printed on the label side.

By thus printing a reference position alignment mark 41 (41'), the printed position of the object can be determined based on the printed reference position alignment mark 41 (41') when additional data is written to the recording medium and information related to the written data content is added to the label side.

Note, further, that the shape of the reference position alignment mark is rectangular in the foregoing embodiment, but the invention is not so limited and another other desired shape, such as round, triangular, or star-shaped, may be used. Yet further, the reference position alignment mark 41 (41') may be printed black, or some other color that contrasts appropriately with the background image already printed on the label side.

As described above, the label printer 110 having a printer control unit 50 according to the foregoing embodiments of the invention rotates the intended printing position of the print object to the printing area 42', 43' of the recording medium M, which is the target printing position where the object should be printed, and can thereby reliably print a desired object in the printing area 42', 43' of the recording medium M.

The invention has been described with reference to preferred embodiments thereof, and it will be obvious to one with ordinary skill in the related art that the invention is not limited to the embodiments described above. For example, a configuration in which the host computer 200 is omitted from the media processing system 500 described above and the function of the host computer 200 is handled by the operating unit 170 and the printer control unit 50 of the media processing device 100 is also conceivable.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart there-from.

What is claimed is:

1. A label printer comprising:

a carriage that moves bi-directionally in a main scanning direction over a disc-shaped recording medium;

a printer tray that is disposed movably in a sub-scanning direction with the recording medium placed thereon;

an ink head that is disposed to the carriage and prints a desired object by discharging ink to a printing area on the recording medium in conjunction with movement of the carriage in the main scanning direction and movement of the printer tray in the sub-scanning direction;

a detection unit that is disposed to the carriage and detects a reference position alignment mark that indicates a rotational position used as a reference for appropriately printing the object in the printing area of the recording medium;

a rotating unit that rotates the recording medium; and a printing operation control unit that rotates the recording medium using the rotating unit so that the object is printed in the printing area of the recording medium, the printing operation control unit calculating the angle of rotation of the recording medium, the angle of rotation calculation being based on the detection of the reference position alignment mark by the detection unit.

2. The label printer described in claim 1, wherein:

the detection unit detects some other object printed in the printing area, or detects a mark outside the printing area, as the reference position alignment mark.

3. The label printer described in claim 1, wherein:

the reference position alignment mark is printed by the ink head, and the object is printed based on the result of detecting the printed reference position alignment mark.

4. A media processing device comprising:

the label printer described in claim 1;

a media storage unit that stores a plurality of disc-shaped recording media; and a media transportation unit that conveys the recording media to the media storage unit and the label printer.

5. A media processing system comprising:

the media processing device described in claim 4; and a host computer that controls operation of the media processing device.

6. The label printer described in claim 1, further comprising:

an indexing mark including a straight side that is disposed on the printer tray; and an angle of rotation calculation unit that calculates an angle of rotation when the reference position alignment mark is not parallel to the straight side of the indexing mark; wherein the printing operation control unit rotates the recording medium based on the angle of rotation calculated by the angle of rotation calculation unit.

7. The label printer described in claim 6, wherein:

the reference position alignment mark is printed by the ink head, and the object is printed based on the result of detecting the printed reference position alignment mark.

8. A media processing device comprising:

the label printer described in claim 6;

a media storage unit that stores a plurality of disc-shaped recording media; and a media transportation unit that conveys the recording media to the media storage unit and the label printer.

9. A media processing system comprising:

the media processing device described in claim 8; and a host computer that controls operation of the media processing device.

10. A label printer comprising:

a carriage that moves bi-directionally in a main scanning direction over a disc-shaped recording medium;

a printer tray that is disposed movably in a sub-scanning direction with the recording medium placed thereon;

an ink head that is disposed on the carriage and prints a desired object by discharging ink to a printing area on the recording medium in conjunction with movement of the carriage in the main scanning direction and movement of the printer tray in the sub-scanning direction;

a sensor that is disposed on the carriage and detects a reference position alignment mark that indicates a rotational position used as a reference for printing the object in the printing area of the recording medium;

a motor that rotates the recording medium; and a controller that rotates the recording medium using the motor so that the object is printed in the printing area of the recording medium, the controller calculating the angle of rotation of the recording medium, the angle of rotation calculation being based on the detection of the reference position alignment mark by the sensor.

11. The label printer described in claim 10, wherein:

the sensor detects some other object printed in the printing area, or detects a mark outside the printing area, as the reference position alignment mark.

* * * * *